US006315588B1

(12) United States Patent
Heberlein et al.

(10) Patent No.: US 6,315,588 B1
(45) Date of Patent: Nov. 13, 2001

(54) DIRECT INSERTION SHORTING CLIP

(75) Inventors: Dennis E Heberlein, Warren; Adam M. Kemp, Youngstown, both of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/510,822

(22) Filed: Feb. 23, 2000

(51) Int. Cl.[7] ..... H01R 29/00
(52) U.S. Cl. ..... 439/188; 200/51.1
(58) Field of Search ..... 439/188; 200/51.1

(56) References Cited

U.S. PATENT DOCUMENTS 4,906,203 3/1990 Margrave et al. .
4,978,311 * 12/1990 Oda et al. ..... 439/188
5,466,168 * 11/1995 Liebich et al. ..... 439/188
5,509,817 * 4/1996 Tsuji ..... 439/188
5,791,922 * 8/1998 Takata et al. ..... 439/188
5,944,547 * 8/1999 Golab et al. ..... 439/188

* cited by examiner

*Primary Examiner*—Tulsidas Patel
*Assistant Examiner*—Hae Moon Hyeon
(74) *Attorney, Agent, or Firm*—Richard A. Jones

(57) ABSTRACT

An electrical connector comprises a plug connector body that has a pair of metal terminals disposed within a pair of laterally disposed terminal cavities and a unitary metal shorting clip disposed within a shorting clip cavity. The unitary metal shorting clip has a single, generally V-shaped cantilevered spring arm at one end that contacts the pair of metal terminals when the electrical connector is disconnected from a mating electrical connector. The shorting clip is retained within the plug connector body by a mounting portion engaging a support shelf within the shorting clip cavity. The support shelf includes a clip rest which pre-loads the shorting clip and limits the spring force of the spring arm which is lifted off the terminals by a cam of the mating electrical connector.

12 Claims, 3 Drawing Sheets

DIRECT INSERTION SHORTING CLIP

TECHNICAL FIELD

The present invention relates to electrical connectors and more specifically, to electrical connectors equipped with a shorting clip which automatically shunts terminals in the electrical connector when the electrical connector is disconnected from a mating electrical connector.

BACKGROUND OF THE INVENTION

Two way electrical female connectors which have a shorting clip housed in a plug connector body are known in the art. A typical two-way shorting clip is a bent wire which has a generally U-shaped body. The shorting clip is typically mounted in a slot above a pair of laterally spaced terminal cavities. The bent wire shorting clip includes two depending legs at the respective ends of the U-shaped body. These depending legs engage the sides of the respective female terminals which are disposed in the terminal cavities of the plug connector body.

A typical male electrical connector has a socket connector body which includes a converging slot at its mating end. The depending legs of the shorting clip are squeezed together and disengaged from the sides of the female terminals by the converging slot when the female connector is plugged into the male connector. The plug connector body of the female connector is also equipped with an external lock arm which secures the female connector to the mating male connector.

Another example of a two way electrical connector is found in U.S. Pat. No. 4,906,203 granted to Margrave, et al Mar. 6, 1990. The Margrave shorting clip is U-shaped but made of sheet metal.

In both cases, the terminals are installed before the shorting clip because of the force required to move the shorting clip once it is installed. Moreover, special tools and processes are required to install the shorting clip into the connector body because the shorting clip must be compressed laterally in order to be inserted into the connector body. Furthermore, special tools are generally required to remove terminals from connectors having shorting clips.

While the two-way electrical connectors discussed above are suitable for many applications, it is desirous to eliminate the need for special tooling and processes to install the shorting clip into the connector body. It is also desirous to be able to install the shorting clip either before or after installing the terminals. It is also desirous to provide an electrical connector that does not require special tools and processes to remove the shorting clip.

SUMMARY OF THE INVENTION

It is an object of the present invention to provide an electrical connector comprising a plug connector body having a pair of laterally disposed terminal cavities, each of which houses a metal terminal. A shorting clip cavity is disposed within the plug connector body in communication with the pair of terminal cavities. A unitary metal shorting clip is disposed within the shorting clip cavity to shunt a pair of terminals. The shorting clip has a single, generally V-shaped cantilevered spring arm.

A feature of the present invention is that the single spring arm of the shorting clip allows for a smaller connector profile.

Another feature of the present invention is that the spring arm has pair of lock notches which cooperate with a pair of lock tabs disposed within the connector body in order to retain the shorting clip.

Another feature of the present invention is a support shelf which extends horizontally within the shorting clip cavity that provides a narrow channel to receive the shorting clip. The support shelf also includes a shorting clip rest to position the shorting clip. The shorting clip rest reduces the stress that may be applied to the shorting clip during connection. Furthermore, the support shelf allows the terminals to be inserted into the plug connector body of the present invention before or after the shorting clip has been inserted.

Another feature of the present invention is a tool relief disposed within the V-shaped spring arm of the shorting clip to allow for the removal of the terminals without special tooling.

Another feature of the present invention is that the free spring arm is movable along a generally vertical path whereby every pair of terminals on an outer row of a harness connector may be shorted. The spring arm is movable in a generally vertical path by engaging a cam disposed within a socket connector body.

Other objects and features of the present invention will become apparent to those skilled in the art in light of the following detailed description of a preferred embodiment of the present invention, setting forth the best mode of the invention contemplated by the inventors and illustrated by the accompanying sheets of drawings.

DESCRIPTION OF THE PREFERRED EMBODIMENT

Figure 1:
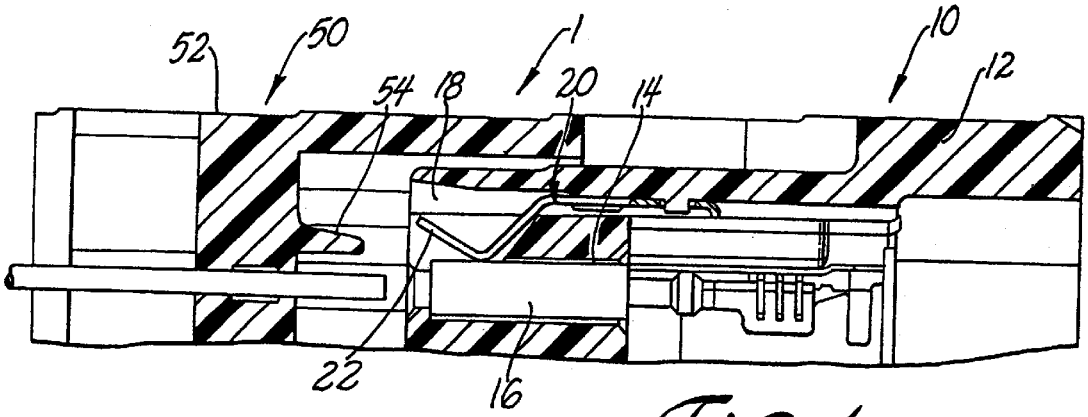
FIG. 1 is longitudinal cross-sectional view of matable electrical plug and socket connectors embodying the present invention shown in the process of being mated.

Referring now to FIG. 1, a longitudinal cross-section view of a mateable, electrical female plug connector 10 and male socket connector 50 are shown. The female electrical connector 10 comprises a plug connector body 12 which has a shorting clip cavity 18 for receiving a unitary metal shorting clip 20 as best shown in FIG. 4.

Figure 2:
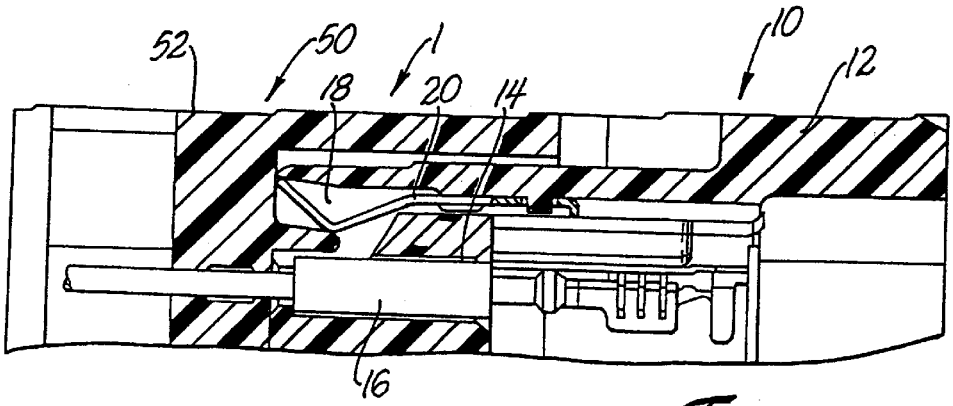
FIG. 2 is a longitudinal cross-sectional view of the electrical plug and socket connectors of FIG. 1 after mating.
Figure 3:
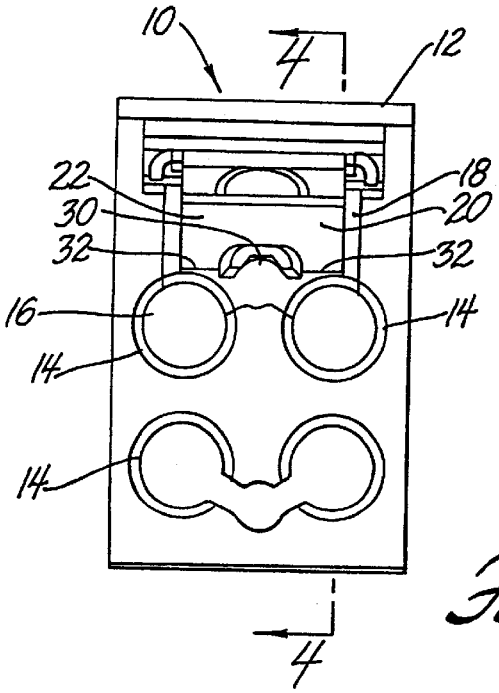
FIG. 3 is a front view of the plug connector shown in FIG. 1.
Figure 4:
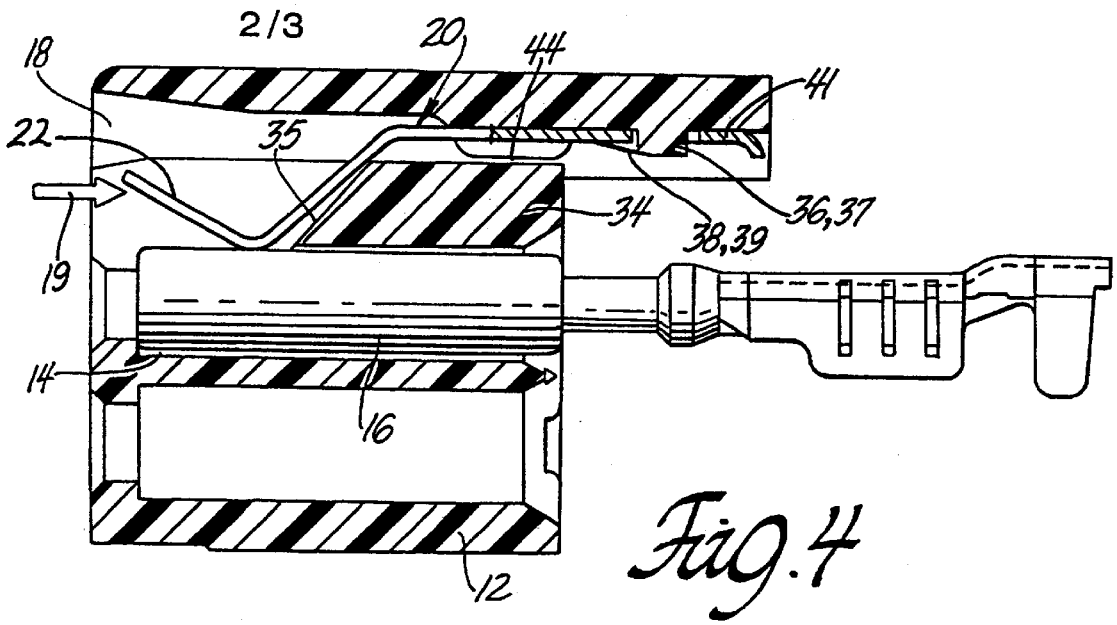
FIG. 4 is a longitudinal cross-sectional view of the plug connector taken substantially along line 4—4 of FIG. 3 looking in the direction of the arrows.
Figure 5:
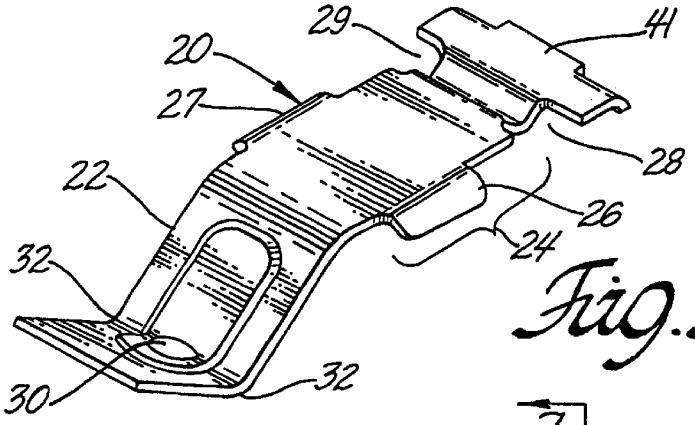
FIG. 5 is an isometric view of the shorting clip shown in FIGS. 1, 2, 3 and 4.

The shorting clip 20 has a single, generally V-shaped cantilevered spring arm 22 as shown in FIG. 5 at one end and a mounting portion 24 at the opposite end. Shorting clip 22 is retained within the plug connector body 12 by mounting portion 24. The plug connector body 12 has upper and lower pairs of laterally spaced terminal cavities 14. Each pair of terminal cavities 14 receive one of a pair of metal female terminals 16. The upper pair of terminal cavities 14 are in communication with the shorting clip cavity 18 so that the spring arm 22 of shorting clip 20 contacts the pair of metal female terminals 16 when the female electrical connector 10 is disconnected as shown in FIGS. 1, 3 and 4. When the female connector 10 is mated with the male connector 50 the spring arm 22 is separated from the terminals 16 by the male connector 50 as shown in FIG. 2.

The V-shaped spring arm 22 of the shorting clip 20 has a contact portion 32 at the apex which engages the pair of metal terminals 16 to produce a shunt, as shown in FIG. 3. The contact portion 32 of the spring arm 22 is moveable along a generally vertical path. Contact with the terminals 16 occurs when the female electrical connector 10 is disconnected, and contact with the terminals 16 is broken when the female electrical connector 10 is connected to the male connector 50. The male electrical connector 50 has a socket connector body 52 having a cam 54 that extends horizontally within the socket connector body 52 for engaging the free slanted end of the cantilevered, V-shaped spring arm 22. Cam 54 engages the free end of spring arm 22 and lifts the spring arm 22 to break electrical contact between the shorting clip 20 and the pair of metal terminals 16 when the male electrical connector 50 is plugged into the female electrical connector 10 as shown in FIG. 2.

Referring now to FIG. 4, a longitudinal cross-sectional view of the plug connector 12 taken along line 4—4 of FIG. 3 is shown. The connector body 12 has a support shelf 34 extending horizontally within the shorting cavity 18 to provide a narrow channel 44. The narrow channel receives the mounting portion 24, as shown in FIG. 5 of the shorting clip 20 which is inserted into the front end of the shorting cavity 18 tail end, 41 first as indicated by the arrow 19 in FIG. 4. The support shelf 34 has an inclined clip rest 35 at the front end that guides the mounting portion 24 into channel 44 and then positions the spring arm 22. When engaged by the spring arm 22 the clip rest 35 provides a pre-load on the spring arm 22 and reduces the spring force applied to the terminals 16 by spring arm 22. The spring force reduction allows the terminals 16 to be installed after the shorting clip 20 during assembly. Electrical connectors of the prior art having a shorting clip require the terminals to be installed before the shorting clip.

Figure 6:
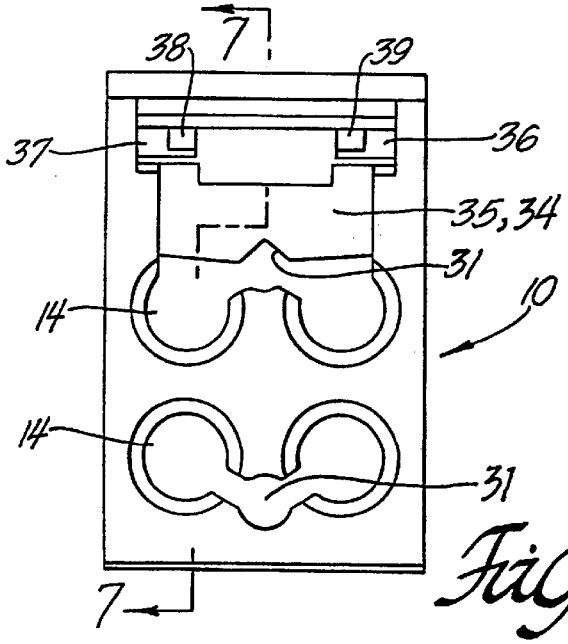
FIG. 6 is a front view of the plug connector body shown in FIGS. 1, 2, 3 and 4.
Figure 7:
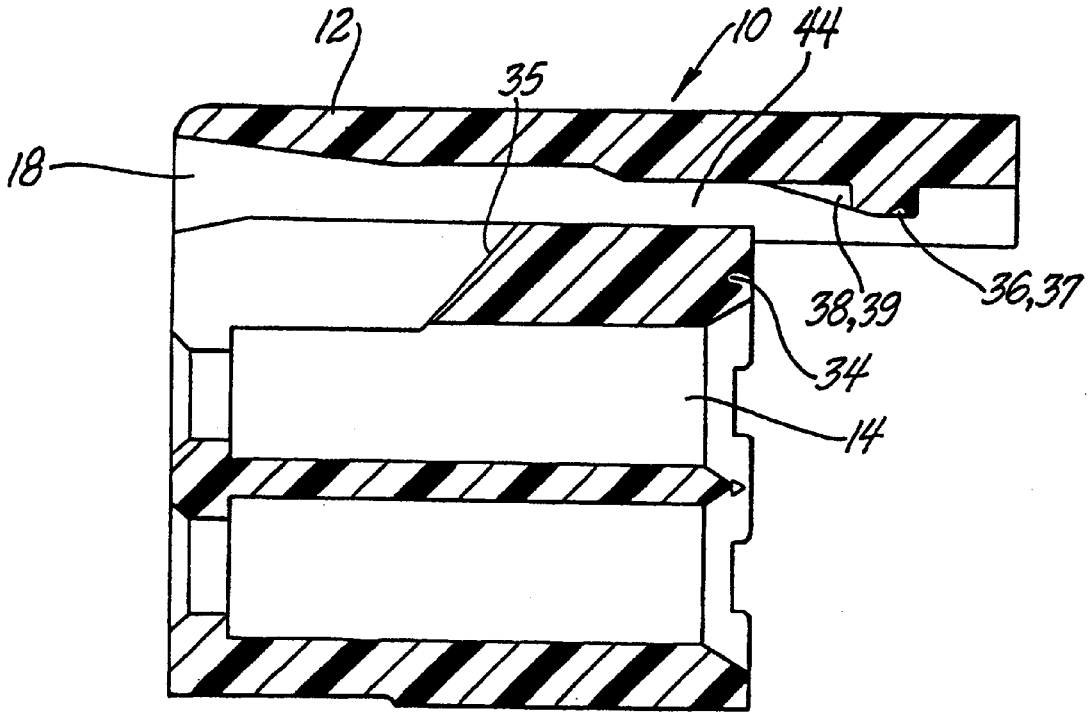
FIG. 7 is a longitudinal cross-sectional view of the plug connector body taken substantially along line 7—7 of FIG. 6 looking in the direction of the arrows.

Referring again to FIG. 4, the shorting clip 20 has a pair of lateral tabs 26, 27 located at the forward end of the mounting portion 24 and a pair of lock notches 28 and 29 located at the aft end. Lock notches 28 and 29 are engaged by a pair of lock tabs 36 and 37 that are disposed within the connector body 12 to retain the shorting clip 20 in clip cavity 18. The lock tabs 36 and 37 prevent the shorting clip 20 from translating horizontally within the plug connector body 12. Lateral tabs 26 and 27 stabilize the mounting portion 24 in the narrow channel 44. A pair of tab guides 38 and 39, which are illustrated in FIGS. 4 and 6 are also disposed within the plug connector body 12 to direct the tail end 41 of the shorting clip 20 over lock tabs 36 and 37 so that lock tabs 36 and 37 are received in lock notches 28 and 29 when the shorting clip 20 is installed.

Figure 8:
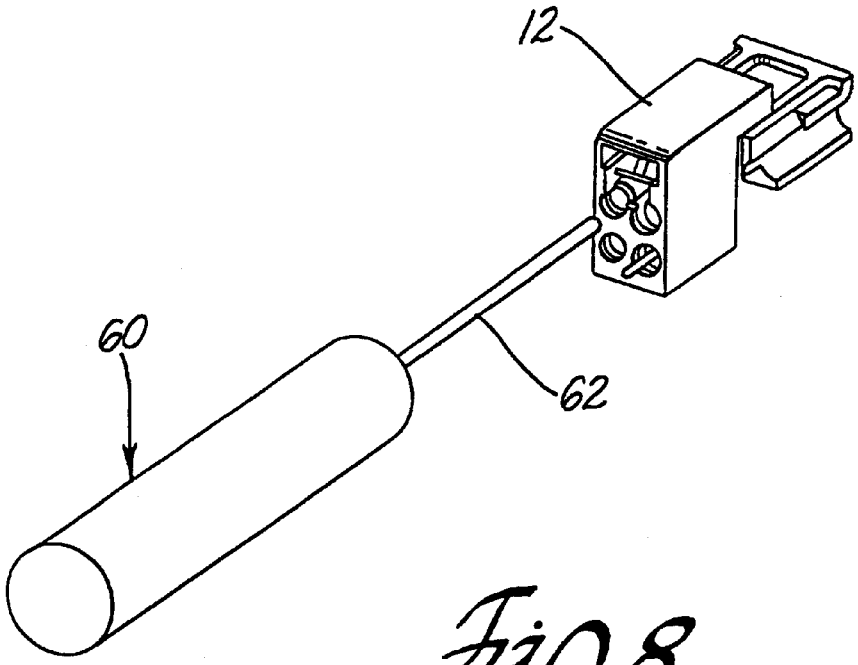
FIG. 8 is an illustration of a terminal service tool poised for removal of a terminal from the plug connector body.

Referring now to FIG. 8, an illustration of a terminal service tool 60 engaging the plug body connector portion 12 is shown. Shorting clip 20 has a tool relief slot 30, at the contact or apex 32 of the V-shaped spring arm 2 as shown in FIGS. 3 and 5. Tool relief slot 30 aligns with an inverted V-shaped notch 31 in the bottom of shelf 34 as shown in FIG. 6. The tool relief slot 30 and aligned notch 31 permit insertion of a standard service tool 60 into the connector 10 to remove the terminals 16. The service tool 60 has a pick 62 that contacts a terminal flex lock (not shown), when the pick 62 is inserted into notch 31 via slot 30 . The flex lock is disengaged by pushing the service tool inward to depress the flex lock, releasing terminals 16 so that terminals 16 can be pulled rearwardly out of terminal cavities 14.

Another embodiment of the present invention may be achieved by incorporating a plurality of shorting clip cavities 18 into an electrical connector adapted to receive a plurality of pairs of laterally spaced terminals 16. For instance a shorting clip 20 and shorting clip cavity 18 could be incorporated into plug connector 10 for the lower pair of terminal cavities 14.

It should become apparent to those skilled in the art that the novel design of the present invention provides an electrical connector 10 that allows for a variety of assembly options. Special tools and processes to insert the shorting clip 20 into the plug connector body 12 are not required for the present invention. Furthermore, the position and function and the shorting clip 20 provides for a lower profile design which results in a smaller connector size than a shorting clip that has two laterally acting spring arms.

The foregoing description discloses and describes various embodiments of the present invention. One skilled in the art will readily recognize from such description, and from the accompanying drawings and claims, that various changes, modifications and variations can be made therein without departing from the spirit and scope of the present invention, and also such modifications, changes and variations are intended to be included within the scope of the following claims.

What is claimed is:

1. An electrical connector comprising:

a plug connector body having a pair of laterally spaced terminal cavities which receive a pair of metal terminals;

a shorting clip cavity disposed within said plug connector body, said shorting clip cavity in communication with said pair of terminal cavities;

a unitary metal shorting clip disposed within said shorting clip cavity, said shorting clip having a single, generally V-shaped cantilevered spring arm and a mounting portion, said shorting clip being retained within said plug connector body the mounting portion of the shorting clip engaged to said plug connector body, said spring arm being in contact with said pair of metal terminals when said electrical connector is in a disconnected state;

a pair of lock notches disposed within said shorting clip adjacent to an aft end of said mounting portion; and a pair of lock tabs disposed within said plug connector body whereby said lock tabs cooperate with said lock notches to retain said shorting clip within said connector body.

2. The electrical connector of claim 1, wherein said plug connector body has a support shelf extending horizontally within said shorting clip cavity to provide a narrow channel for receiving said shorting clip.

3. The electrical connector of claim 1, wherein said shorting clip has a tool relief disposed within said spring arm.

4. An electrical connector comprising:

a plug connector body having a pair of laterally spaced terminal cavities which receive a pair of metal terminals;

a shorting clip cavity disposed within said plug connector body, said shorting clip cavity in communication with said pair of terminal cavities;

a unitary metal shorting clip disposed within said shorting clip cavity, said shorting clip having a single, generally V-shaped cantilevered spring arm and a mounting portion, said shorting clip being retained within said plug connector body the mounting portion of the shorting clip engaged to said plug connector body, said spring arm being movable along a generally vertical path to contact said pair of metal terminals when said electrical connector is disconnected; and a support shelf extending horizontally within said shorting clip cavity said support shelf defining a narrow channel for receiving said shorting clip.

5. The electrical connector of claim 4, wherein said spring arm is movable along a generally vertical path by engaging a cam disposed within a socket connector body.

6. The electrical connector of claim 4, wherein said spring arm does not contact said pair of metal terminals when said electrical connector is connected.

7. The electrical connector of claim 4, wherein said support shelf includes an inclined clip rest for positioning said spring arm.

8. An electrical connector comprising:

a plug connector body having a plurality of laterally spaced terminal cavity pairs, each of said terminal cavities of each one of said plurality of laterally spaced terminal cavity pairs for receiving one of a pair of metal terminals, a plurality of shorting clip cavities disposed within said plug connector body, each one of said plurality of shorting clip cavities in communication with a respective one of said plurality of terminal cavity pairs; and a unitary metal shorting clip disposed within each respective one of said plurality of shorting clip cavities, each one of said plurality of shorting clip cavities having a single, generally V-shaped cantilevered spring arm and a mounting portion, said shorting clip being retained within said plug connector body, the mounting portion of the shorting clip engaged to said plug connector body, said spring arm being in contact with said pair of metal terminals when said electrical connector is disconnected.

9. The electrical connector of claim 8, further comprising:

a pair of lock notches disposed within said shorting clip adjacent to an aft end of said mounting portion; and a pair of lock tabs disposed within said plug connector body, whereby said lock tabs cooperate with said lock notches to retain said shorting clip within said lock connector body.

10. The electrical connector of claim 9, wherein said plug connector body has a plurality of support shelves, each one of said plurality of support shelves extending horizontally within each respective one of said plurality of shorting clip cavities to provide a narrow channel for receiving said shorting clip within each respective one of said shorting clip cavities.

11. The electrical connector of claim 8, wherein said shorting clip has a tool relief disposed within said free end portion.

12. An electrical connector comprising:

a plug connector body having an upper pair and a lower pair of laterally spaced terminal cavities;

an upper pair and a lower pair of metal terminals disposed respectively in said upper pair and lower pair of terminal cavities; and an upper and a lower shorting clip cavity disposed within said plug connector body, each of said shorting clip cavities in communication with each respective one of said upper pair and lower pair of terminal cavities; and an upper and a lower unitary metal shorting clip disposed respectively within each of said upper and lower shorting clip cavities, said upper and lower shorting clips each having a single, generally V-shaped cantilevered spring arm and a mounting portion, said shorting clip being retained within said plug connector body, the mounting portion of the shorting clip engaged to said plug connector body, said spring arm having a contact portion for engaging a respective one of the upper and lower pairs of metal terminals when said electrical connector is disconnected, wherein the spring arm of the upper shorting clip moves vertically and in opposition to the vertical movement of the spring arm of the lower shorting clip.

* * * * *